US005966058A

United States Patent [19]

Davidovitz

[11] Patent Number: 5,966,058

[45] Date of Patent: Oct. 12, 1999

[54] APERTURE-COUPLED MULTIPLANAR MAGIC-T JUNCTION

[75] Inventor: Marat Davidovitz, Belmont, Mass.

[73] Assignee: The United States of America as represented by the Secretary of the Air Force, Washington, D.C.

[21] Appl. No.: 09/006,526

[22] Filed: Jan. 13, 1998

[51] Int. Cl.[6] ..... H01P 5/16

[52] U.S. Cl. ..... 333/121; 333/122

[58] Field of Search ..... 333/116, 121, 333/122, 128, 26

[56] References Cited

U.S. PATENT DOCUMENTS 2,976,499 3/1961 Sferrazza ..... 333/116 X
3,513,414 5/1970 Howe, Jr. ..... 333/116
3,670,268 6/1972 Connerney ..... 333/122
5,303,419 4/1994 Ittipiboon et al. ..... 333/121

*Primary Examiner*—Paul Gensler
*Attorney, Agent, or Firm*—William G. Auton

[57] ABSTRACT

The present invention is a compact, multiplanar magic-T junction that generally consists of four planar waveguides and/or planar transmission lines, with at least one planar waveguide or planar transmission line residing in a different circuit layer from the other planar waveguides and/or transmission lines. Each planar waveguide and planar transmission line in the multiplanar magic-T junction is electromagnetically connected to an input/output feeding port with which it communicates. The ground planes common to the planar transmission lines and/or planar waveguides in the magic-T junction contain a coupling aperture. The planar waveguides and planar transmission lines which are on different sides of the common ground planes of the magic-T junction communicate electromagnetically through this coupling aperture.

1 Claim, 4 Drawing Sheets

APERTURE-COUPLED MULTIPLANAR MAGIC-T JUNCTION

STATEMENT OF GOVERNMENT INTEREST

The invention described herein may be manufactured and used by or for the Government for governmental purposes without the payment of any royalty thereon.

BACKGROUND OF THE INVENTION

This invention relates generally to a compact, multiplanar magic-T junction that electromagnetically connects planar waveguides and/or planar transmission lines, while allowing conduction of electrical current or transfer of electromagnetic energy through and between these planar waveguides and planar transmission lines. More specifically, the planar magic-T junction of the current invention contains a difference port that is separated from its other three ports by a ground plane.

In general terms, a magic-T junction consists of a waveguide arrangement with four branches, in which energy is transferred from any one branch into two of the three remaining branches. A signal which enters one branch will divide and emerge from the two adjacent terminal branches, but will be unable to reach the opposite terminal branch.

A waveguide arrangement may consist of one or more planar waveguides and one or more planar transmission lines, with the total number of planar waveguides and planar transmission lines usually not exceeding four. A planar waveguide is formed by a solid dielectric rod or a dielectric filled tubular conductor capable of guiding electromagnetic waves. A planar transmission line for guiding electromagnetic waves generally takes the form of one or more extended, narrow members of uniform width which is commonly designated as a microstrip line when the member is a conducting strip insulated from a single ground plane by a dielectric. The narrow member or members may generally be conductors.

Many microwave and millimeterwave systems utilize planar waveguides and planar transmission lines. The signals from such waveguides are often used in hybrid and monolithic integrated circuits, and are of planar construction.

When planar transmission lines are used in conjunction with planar waveguides, wave energy must be coupled between the associated planar transmission lines and planar waveguides. Prior art techniques for such coupling are illustrated in the following U.S. Patents, the disclosures of which are incorporated herein by reference: U.S. Pat. No. 4,754,239 to Sedivec; U.S. Pat. No. 4,143,342 to Cain et at; U.S. Pat. No. 3,969,691 to Saul; U.S. Pat. No. 3,882,396 to Schneider; U.S. Pat. No. 3,755,759 to Cohn; U.S. Pat. No. 3,732,508 to Ito et al; U.S. Pat. No. 3,579, 149 to Ramsey; and U.S. Pat. No. 3,483,489 to Dietrich.

A magic-T junction is commonly found in microwave and millimeterwave circuit components, and is employed in devices such as amplifiers, power distribution networks and mixers, as disclosed by M. Davidovitz in "A Planar Magic-T Junction with Aperture-Coupled Difference Port," IEEE Microwave and Guided Wave Letters, August 1997, which is incorporated herein by reference. Prior to the present invention, the only magic-T junctions available for use in these and other devices were uniplanar, in that all of the input-output ports leading into these magic-T junctions resided in the same ground plane. This design causes complications such as routing problems, as lines from the input-output ports of the components are forced to cross on the same level. The multiplanar magic-T junction of the present invention overcomes routing problems, and can be easily integrated into microwave and millimeterwave integrated circuits.

SUMMARY OF THE INVENTION

The present invention is a compact, multiplanar magic-T junction that generally consists of four planar waveguides and/or planar transmission lines, with at least one planar waveguide or planar transmission line residing in a different layer from the other planar waveguides and/or transmission lines. Each planar waveguide and planar transmission line in the multiplanar magic-T junction is electrically connected to an input/output feeding port with which it communicates. As with a uniplanar magic-T junction, the multiplanar magic-T junction only allows communication between adjacent ports.

The common ground plane in the magic-T junction contains a coupling aperture. The planar waveguides and planar transmission lines which are in different layers of the magic-T junction communicate electromagnetically through this coupling aperture.

Uniplanar magic-T junctions create routing problems and functional limitations in many systems, such as complex feed-networks, because the planar waveguides and planar transmission lines from the input-output feeding ports are often forced to cross over each other. By distributing the input-output feeding ports on more than one layer, along with their related planar waveguides and planar transmission lines, design complexity and production costs can be significantly reduced. Notably, this multiplanar magic-T junction allows for simpler integration of magic-T junctions into microwave and millimeterwave integrated circuits than could previously be achieved.

Several U.S. Patents disclose uniplanar magic-T junctions, such as U.S. Pat. No. 3,931,599 issued to Salzberg, the disclosure of which is incorporated herein by reference. It is significant that none disclose multiplanar magic-T junctions.

It is an object of the present invention to provide a multiplanar magic-T junction which contains at least one planar waveguide or planar transmission line entering or exiting the magic-T junction on a different circuit layer from the other planar waveguides and/or planar transmission lines.

It is a further object of the invention to allow hermetic isolation between the different layers of the magic-T junction.

It is still a further object of the invention to provide a more compact and flexible magic-T junction structure, so that a magic-T junction can be more effectively incorporated into multilayer integrated circuit components.

These and many other objects and advantages of the present invention will become more readily apparent to one skilled in the pertinent art from the following detailed description when taken in conjunction with the accompanying drawings wherein like elements are given like reference numerals throughout.

BRIEF DESCRIPTION OF THE DRAWINGS

For the purpose of illustrating the invention, there is shown in the drawings embodiments which are presently preferred. It is understood, however; that, the invention is not limited to the precise arrangements and instrumentalities shown. In the drawings:

FIG. 2B and FIG. 2C are graphs of S in db plotted against f in Ghz for various two-feeding port combinations for the multiplanar magic-T junction of FIG. 2A.

DETAILED DESCRIPTION OF THE PREFERRED EMBODIMENT

This invention provides a compact, multiplanar magic-T junction. The waveguide arrangement for this multiplanar magic-T junction may consist of one or more planar waveguides and one or more planar transmission lines, with the total number of planar waveguides and planar transmission lines usually not exceeding four. Uniplanar magic-T junctions have been well known for some time, but they do not allow for the flexibility and compactness in design that the present invention, the multiplanar magic-T junction, permits.

Figure 1A:
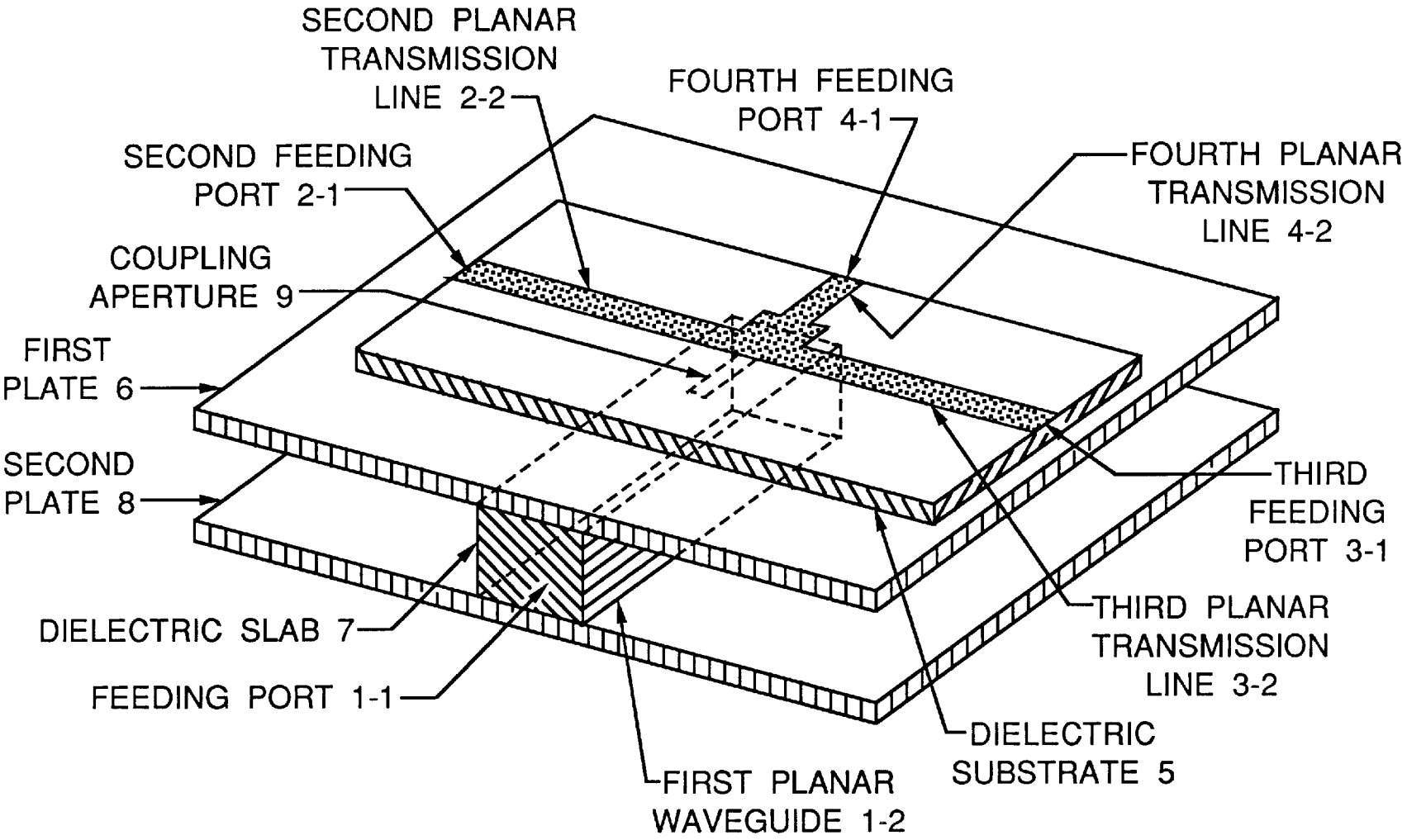
FIG. 1A is a perspective view of a multiplanar magic-T junction in accordance with the invention, in which the waveguide arrangement of the magic-T junction consists of one planar waveguide and three planar transmission lines.

FIG. 1A depicts the present invention with a waveguide arrangement of one planar waveguide and three planar transmission lines. The reader's attention is now directed to FIG. 1A, which is a perspective view of a multiplanar magic-T junction with one planar waveguide and three planar transmission lines. This multiplanar magic-T junction includes a first feeding port 1-1, a first planar waveguide 1-2, a second feeding port 2-1, a second planar transmission line 2-2, a third feeding port 3-1, a third planar transmission line 3-2, a fourth feeding port 4-1, a fourth planar transmission line 4-2, a dielectric substrate 5, a first plate 6, a dielectric slab 7, a second plate 8, and a coupling aperture 9. The coupling aperture 9 is contained within the first plate 6. Although the first planar waveguide depicted in FIG. 1A is a Nonradiating Dielectric Waveguide, other types of waveguides may also be employed.

The first feeding port 1-1 and the first planar waveguide 1-2 both reside between the first plate 6 and the second plate 8. The dielectric slab 7, which is also found between the first plate 6 and the second plate 8, extends from the location of the first feeding port 1-1 to a point which is usually beyond the coupling aperture 9. The exact length of this dielectric slab 7 may vary as the material used to form the dielectric slab 7 varies.

The second feeding port 2-1, the second planar transmission line 2-2, the third feeding port 3-1, the third planar transmission line 3-2, the fourth feeding port 4-1, and the fourth planar transmission line 4-2 all reside on the top surface of the dielectric substrate 5, and are electromagnetically connected to the first feeding port 1-1 and the first planar waveguide 1-2 through the coupling aperture 9 in the, first plate 6.

When electromagnetic energy enters one of the planar magic-T junction's feeding ports, it travels into the feeding ports' respective planar waveguide or planar transmission line. Each feeding port can communicate, through the planar waveguide and planar transmission lines, with adjacent feeding ports. Accordingly, the second feeding port 2-1 may communicate directly with the fourth feeding port 4-1 or the first feeding port 1-l, but not with the third feeding port 3-1.

Communication between circuit layers is permitted through the coupling aperture. For instance, electromagnetic communication between the second feeding port 2-1 and the first feeding port 1-1 could begin with the second feeding port 2-1 providing a signal to the second planar transmission line 2-2, which would send a signal through the coupling aperture 9, into the first planar waveguide 1-2, and into the first feeding port 1-1.

Figure 1B:
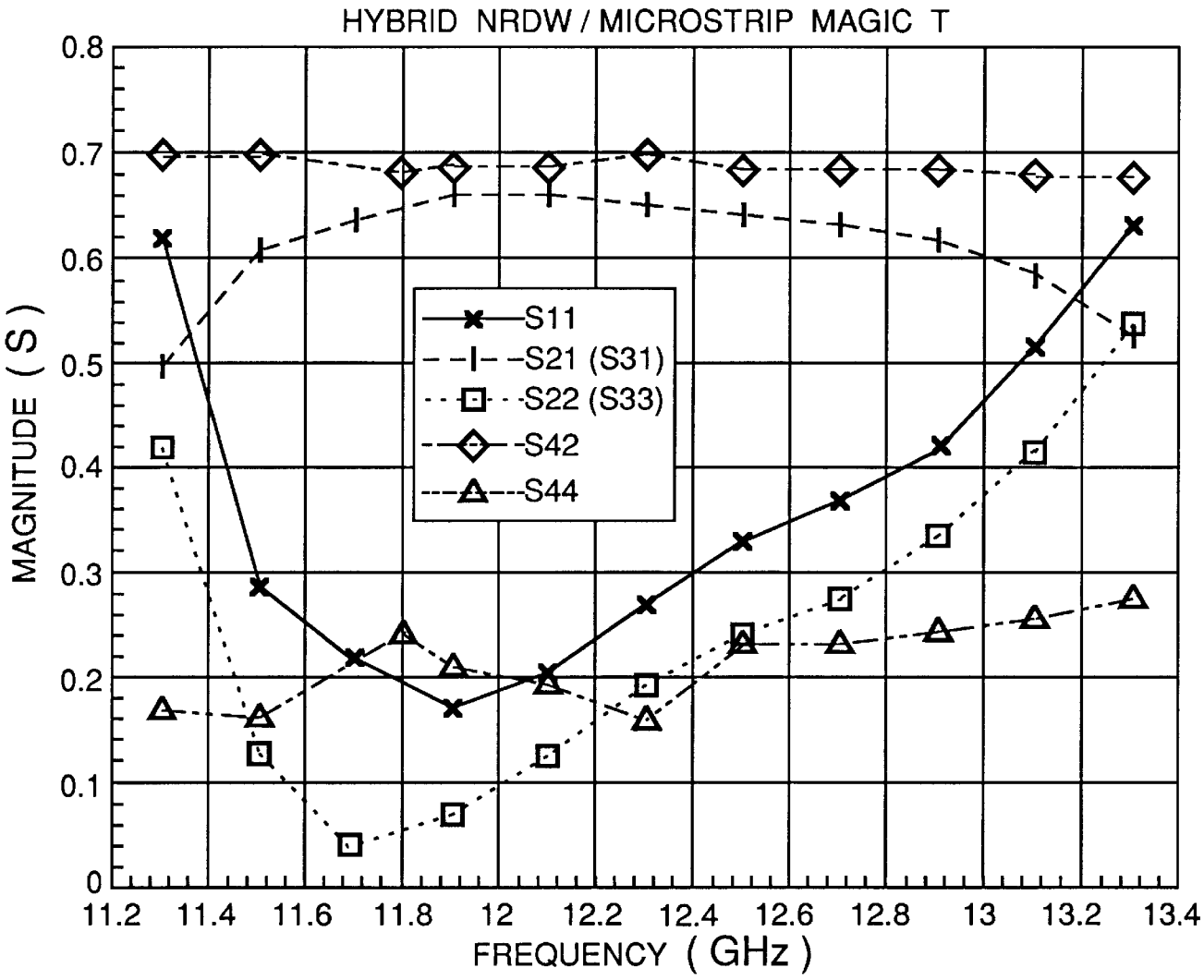
FIG. 1B is a graph of scattering parameter magnitude (S) in decibels (db) plotted against frequency (f) in Gigahertz (Ghz) for various two-feeding port combinations for the multiplanar magic-T junction of FIG. 1A.

Various performances of the one planar waveguide and three planar transmission line configuration of FIG. 1A are illustrated in FIG. 1B. Feeding port measurements were performed for several feeding port combinations. These performances were measured over the range from 11.2 to 13.4 Gigahertz (GHz). FIG. 1B is a graph illustrative of test results showing scattering parameter magnitude (S) in decibels (db) plotted against frequency (f) in GHz for the waveguide configuration of FIG. 1A. The test results for FIG. 1B are approximate, and even more accurate results are expected with more precise calibration.

Figure 2A:
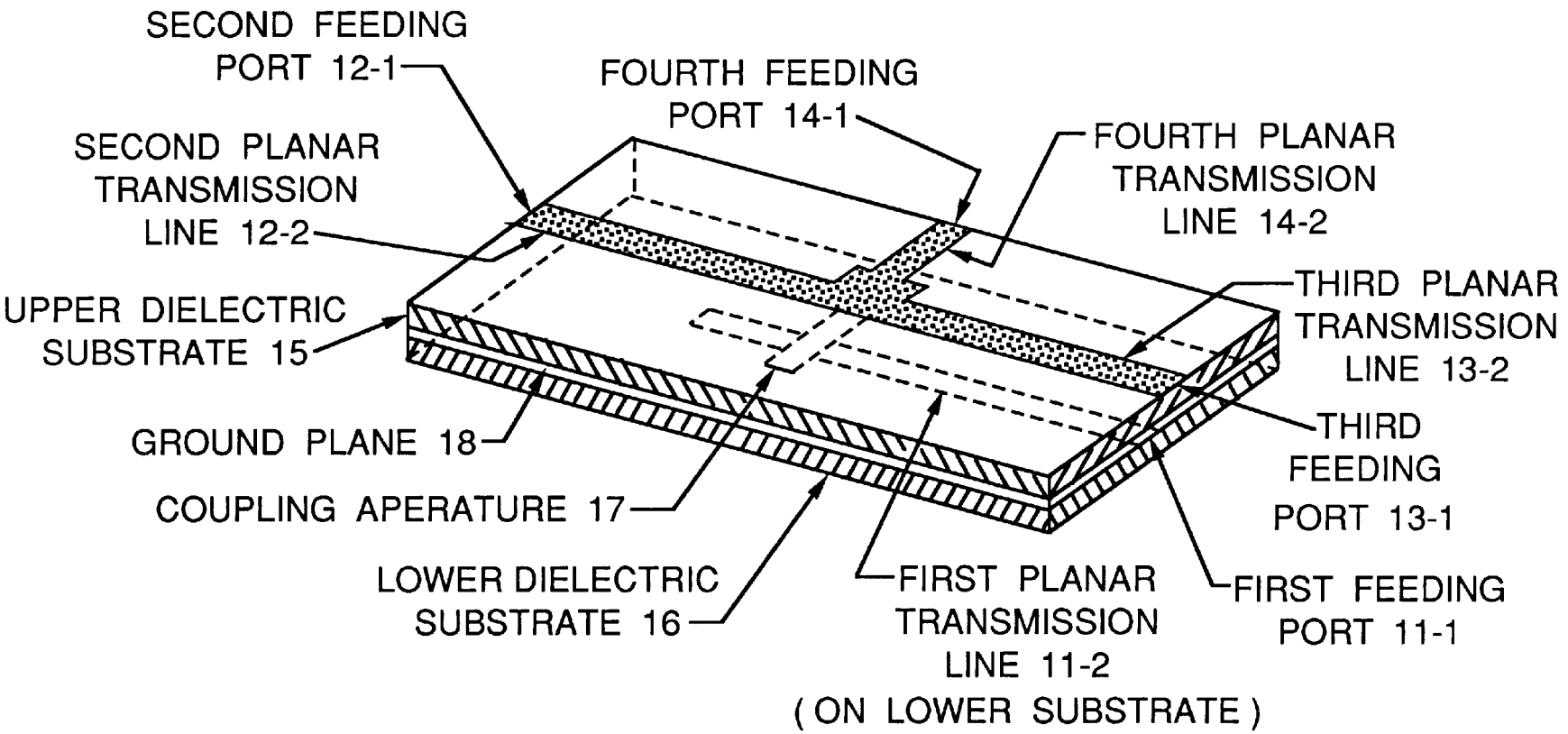
FIG. 2A is a perspective view of a multiplanar magic-T junction in accordance with the invention, in which the waveguide arrangement of the magic-T junction consists of four planar transmission lines.

FIG. 2A depicts a second variation of the present invention, where the waveguide arrangement consists of four planar transmission lines. The reader's attention is now directed to FIG. 2A, which is a perspective view of a multiplanar magic-T junction with four planar transmission lines. This arrangement consists of a first feeding port 11-1, a first planar transmission line 11-2, a second feeding port 12-1, a second planar transmission line. 12-2, a third feeding port 13-1, a third planar transmission line 13-2, a fourth feeding port. 14-1, a fourth planar transmission line 14-2, an upper dielectric substrate 15, a lower dielectric substrate 16, a coupling aperture 17, and a ground plane 18. The coupling aperture 17 is contained on the ground plane 18, and the ground plane 18 resides between the upper dielectric substrate 15 and the lower dielectric substrate 16.

In FIG. 2A, the first feeding port 11-2 and the first planar transmission line 11-2 reside on the lower side of the lower dielectric substrate 16, while the second feeding port 12-1, the second planar transmission line 12-2, the third feeding port 13-1, the third planar transmission line 13-2, the fourth feeding port 14-1, and the fourth planar transmission line 14-2 reside on the upper dielectric substrate 15. Communication between the feeding ports and between the ground planes in the four planar transmission line arrangement is substantially the same as with the configuration of FIG. 1A.

Figure 2B:
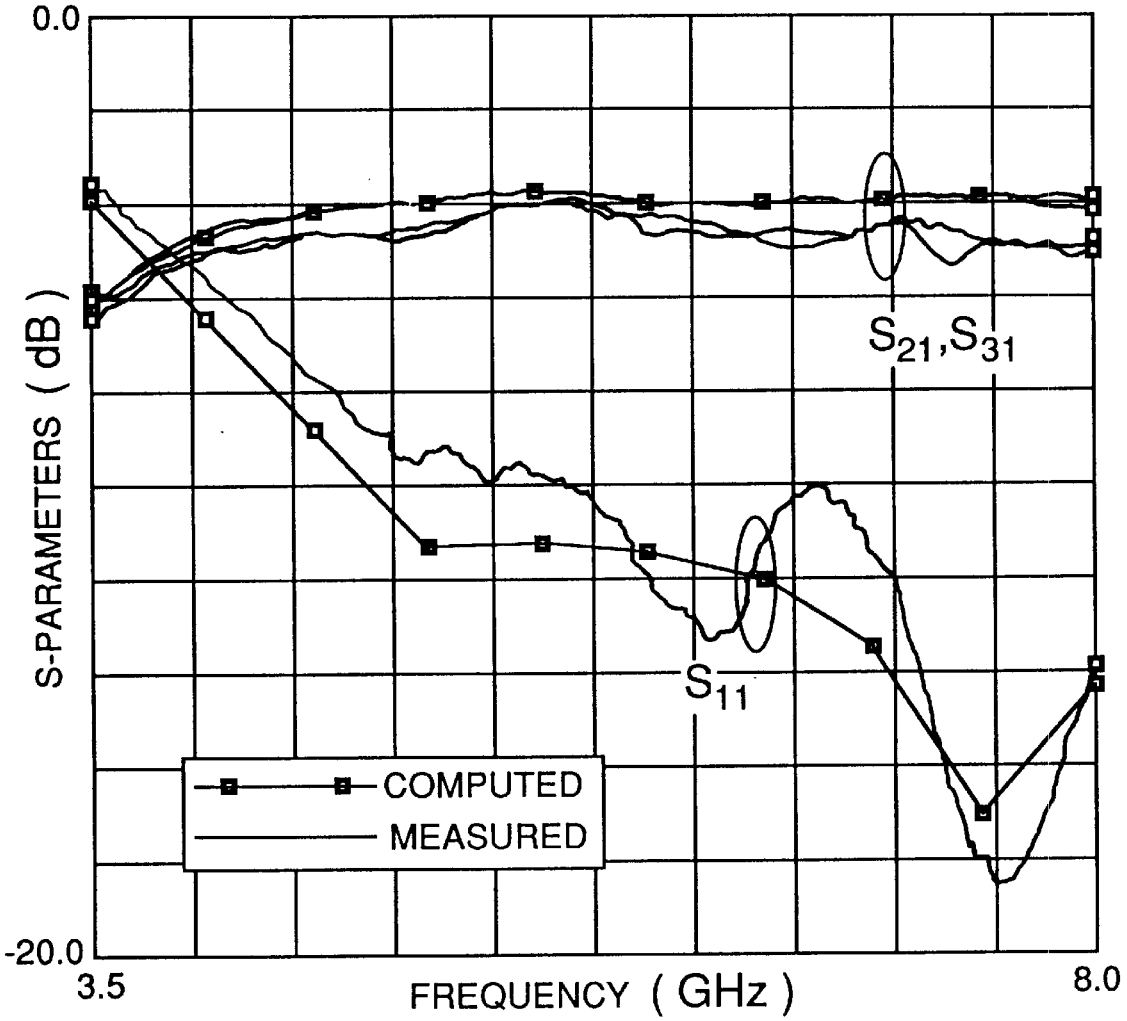

Various performances of the four planar transmission line configuration of FIG. 2A are illustrated in FIG. 2B and in FIG. 2C. Feeding port measurements were performed for several feeding port combinations. These performances were measured over the range from 3.5 to 8.0 Gigahertz (GHz). FIG. 2B and FIG. 2C are graphs illustrative of test results showing magnitude (S) in decibels (db) plotted against frequency (f) in GHz for the waveguide configuration of FIG. 2A. The test results for FIG. 2B and FIG. 2C are approximate, and even more accurate results are expected with more precise calibration.

The planar transmission lines employed in FIG. 1A and in FIG. 2A consist of an extended, narrow member of uniform width. Although microstrip lines are utilized in both FIG. 1A and FIG. 2A, any type of planar transmission lines may be used with the multiplanar magic-T junction. The planar waveguide employed in FIG. 1A consists of either a solid dielectric rod or a dielectric filled tubular conductor capable of guiding electromagnetic waves. In addition, the coupling apertures employed by the various configurations of the multiplanar magic-T junction will normally be more narrow in width than the planar transmission lines and/or planar waveguides with which the coupling apertures are parallel.

The present invention is a general use component and, accordingly, can be used in a wide variety of systems that transmit or receive radio frequency signals. Such systems include microwave communication link equipment, microwave radar systems, and antenna systems.

Additionally, in many current phased-array applications, complex integrated circuits required to support each radiating element are constrained to relatively small areas. To achieve the required functionality, the components are distributed over several interconnected layers. Typically, the interconnects (such as vias and aperture couplers) are treated as separate elements. More compact and efficient architectures result, however, if the interconnects are integrated into circuit component, and the unique design and flexibility of the multiplanar magic-T junction allows for such integration.

While the invention has been described in its presently preferred embodiment, it is understood that the words which have been used are words of description rather than words of limitation, and that changes within the purview of the appended claims may be made without departing from the scope and the spirit of the invention in its broader aspects.

What is claimed is:

1. An aperture-coupled, multiplanar magic-T junction comprising:

a dielectric substrate having a central aperture;

a planar transmission line T with three feeding ports mounted on the dielectric substrate, the planar transmission line T having a junction area placed over the central aperture of the dielectric substrate;

a planar waveguide with a port mounted beneath the dielectric substrate, said planar waveguide having an opening directed at the central aperture of the dielectric substrate to permit electromagnetic waves to couple into the planar transmission line T, said planar waveguide having a port which permits electromagnetic waves to be conducted to and from the magic-T.

* * * * *